US006064001A

United States Patent [19]

Ulerich et al.

[11] Patent Number: 6,064,001

[45] Date of Patent: May 16, 2000

[54] HIGH CURRENT ELECTRICAL SWITCHING APPARATUS WITH POLES INTERLEAVED AND MODULES JOINED BY INTERFERENCE FIT OF JOINING BLOCK IN UNDERCUT GROOVES IN MOLDED CASINGS

[75] Inventors: Phillip L. Ulerich, Pittsburgh; William J. Jones, Cranberry Township; Norman J. Phillips, Pittsburgh, all of Pa.; Frank Roth, Fairfield, Ohio

[73] Assignee: Eaton Corporation, Cleveland, Ohio

[21] Appl. No.: 09/074,284

[22] Filed: May 7, 1998

[51] Int. Cl.[7] ..... H01J 5/00

[52] U.S. Cl. ..... 174/50; 307/112; 307/113; 361/13; 361/76; 335/10; 335/152; 200/206

[58] Field of Search ..... 174/50; 307/112, 307/113, 125, 127, 139; 361/8, 13, 76, 77, 84, 85; 335/8–10, 152; 200/206, 207

[56] References Cited

U.S. PATENT DOCUMENTS 3,936,782 2/1976 Moakler et al. ..... 335/161
4,021,704 5/1977 Norbeck ..... 361/77
4,275,429 6/1981 Church et al. ..... 361/64
4,884,047 11/1989 Baginski et al. .
4,958,135 9/1990 Baginski et al. .
5,267,117 11/1993 Moore ..... 361/77

*Primary Examiner*—Kristine Kincaid
*Assistant Examiner*—Dhiru R Patel
*Attorney, Agent, or Firm*—Martin J. Moran

[57] ABSTRACT

Two molded case electrical switches such as circuit breakers, network protectors, disconnect switches and transfer switches, are secured together side-by-side by joining blocks having tongues extending along their sidewalls which engage undercutting grooves undercutting the irregular surfaces of the confronting sidewalls of the switch molded casings with an interference fit. Separate joining blocks for the front and rear sections of the molded casing are driven into place and retained by bolts engaging flanges on the molded casing. The poles are paralleled by external conductors in any desired configuration so that the standard switches can be used without customization.

22 Claims, 5 Drawing Sheets

HIGH CURRENT ELECTRICAL SWITCHING APPARATUS WITH POLES INTERLEAVED AND MODULES JOINED BY INTERFERENCE FIT OF JOINING BLOCK IN UNDERCUT GROOVES IN MOLDED CASINGS

The Government has rights in this invention under Government Contract Number N61331-94-C-0078

BACKGROUND OF THE INVENTION

1. Field of the Invention

This invention relates to high current electrical switching apparatus for electrical power distribution systems. More particularly, it relates to the joining of the multiple switching units together side-by-side, and electrically connecting them to share the current load.

2. Background Information

Electrical switching apparatus for electric power distribution systems includes circuit breakers and network protectors which provide protection, and electrical switches for isolating parts of the distribution system and for transferring between alternative sources. While families of such switches are produced having a range of current ratings, some applications require higher current ratings than are available from the standard units. It is not practical to make a dedicated switch for such applications in view of the limited demand. It is therefore common to mount a pair of such switches side-by-side and connect the poles to share the current. This parallel construction technique is of particular value with molded case switches where the required investment in the molded case is quite large and can be avoided by adjoining two smaller cases. Typically, the casings have been bolted together. U.S. Pat. No. 4,884,047 suggests joining the molded cases together by bolting a spacer to the two casings and then filling the remaining space with a cold-cast resin which hardens and engages reliefs in the confronting sidewalls of the molded casings.

When joining two multipole switches side-by-side, it is standard practice to parallel connect adjacent pole units, either internal to the switch or immediately outside. This produces an AABBCC phase identity. This method of parallel connecting adjacent poles is quite simple; however, it has several disadvantages. Not only is the switch dedicated to a single three pole construction, but the parts used to perform the parallel connection function are used exclusively in that larger frame size and thus in limited production volumes. More importantly, we have found that the ampacity of the individual pole units are not additive when adjacent poles are parallel connected. In fact, in larger sizes, such as 2,000 or 3,000 ampere pole units, the double-pole construction must be derated by as much as twenty percent compared to the combined reading of the two individual pole units.

There is a need, therefore, for improved electrical switching apparatus which combines two smaller multipole switching units to produce a unit with a higher current capacity.

There is a more particular need for a simple, reliable arrangement for joining multipole switching units, especially which does not require cold-casting a resin.

There is also a need for such multipole switching apparatus combining two smaller units which does not result in a substantial derating of the unit over the combined readings of the individual units.

SUMMARY OF THE INVENTION

These needs and others are satisfied by the invention which is directed to electrical switching apparatus which includes a pair of side-by-side multipole switching units having molded casings with confronting sidewalls with irregular surfaces. The irregular surfaces include at least one undercutting groove undercutting the irregular surface. A joining block for joining the two molded casings has sidewalls with tongues extending generally along the sidewall and sized to form an interference fit with the undercutting groove in a confronting molded case sidewall as the joining block is driven between the two casings. A stop member secured to the molded casings of the two switching units prevents the joining block from backing out of the grooves in the molded casings. The undercutting grooves in the molded casings form a finger with an inwardly inclined inner surface. The tongues have inwardly inclined inner surfaces which engage the inner surface on the fingers to effect the interference fit. Preferably, the joining block has an outer engagement surface adjacent the tongue which projects toward and engages the sidewall of the molded casing to provide clearance for the tongue to bend outwardly from the joining block upon engagement with the finger. Also preferably, the joining block has a recess facing the inwardly inclined inner surface on the tongue to provide clearance for the finger on the molded casing to bend outward from the casing upon engagement with the tongue.

With the undercutting grooves forming the fingers positioned adjacent one end of the sidewalls on the molded casings, the stop member is provided at the other end to balance the loading on the joining block. It is most preferred that means be provided to prevent the tongue of the joining block disengaging from the undercutting groove by lateral displacement during operation of the switch. This can be accomplished where the finger on the molded casing only extends laterally over a portion of the sidewall. A projection on the joining block laterally engages the finger with the tongue engaging the undercutting groove to prevent lateral displacement of the joining block.

Typically, the molded casings have an upper undercutting groove in the sidewalls forming handles for lifting the switch, and lower undercutting grooves which engage a cassette for mounting the switching unit in a cabinet. Thus, it is preferred that the joining block have tongues for engaging each of these undercutting grooves with an interference fit.

In switching units having a molded casing with a front casing and a rear casing, each of which have one or more undercutting grooves in confronting sidewalls, the joining block comprises a front joining block with tongues which form interference fits with the undercutting grooves in the front casing sidewalls and a rear joining block with tongues which form an interference fit with the corresponding undercutting grooves in the sidewalls of the rear casing.

The joining block or blocks have a width sized to maintain the established spacing between the adjacent poles of the joined switching units. The stop member is preferably an elongated member which engages openings in flanges on the two molded casings and which also engages the joining block, preferably adjacent its driven end.

In accordance with another aspect of the invention, the poles of the two side-by-side switching units are joined by external conductors to connect corresponding poles in interleaved fashion, for instance ABCABC, or ABCCBA. The connections are made externally to the switches, so that no customized parts are required and flexibility is maintained for any type of connection desired.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
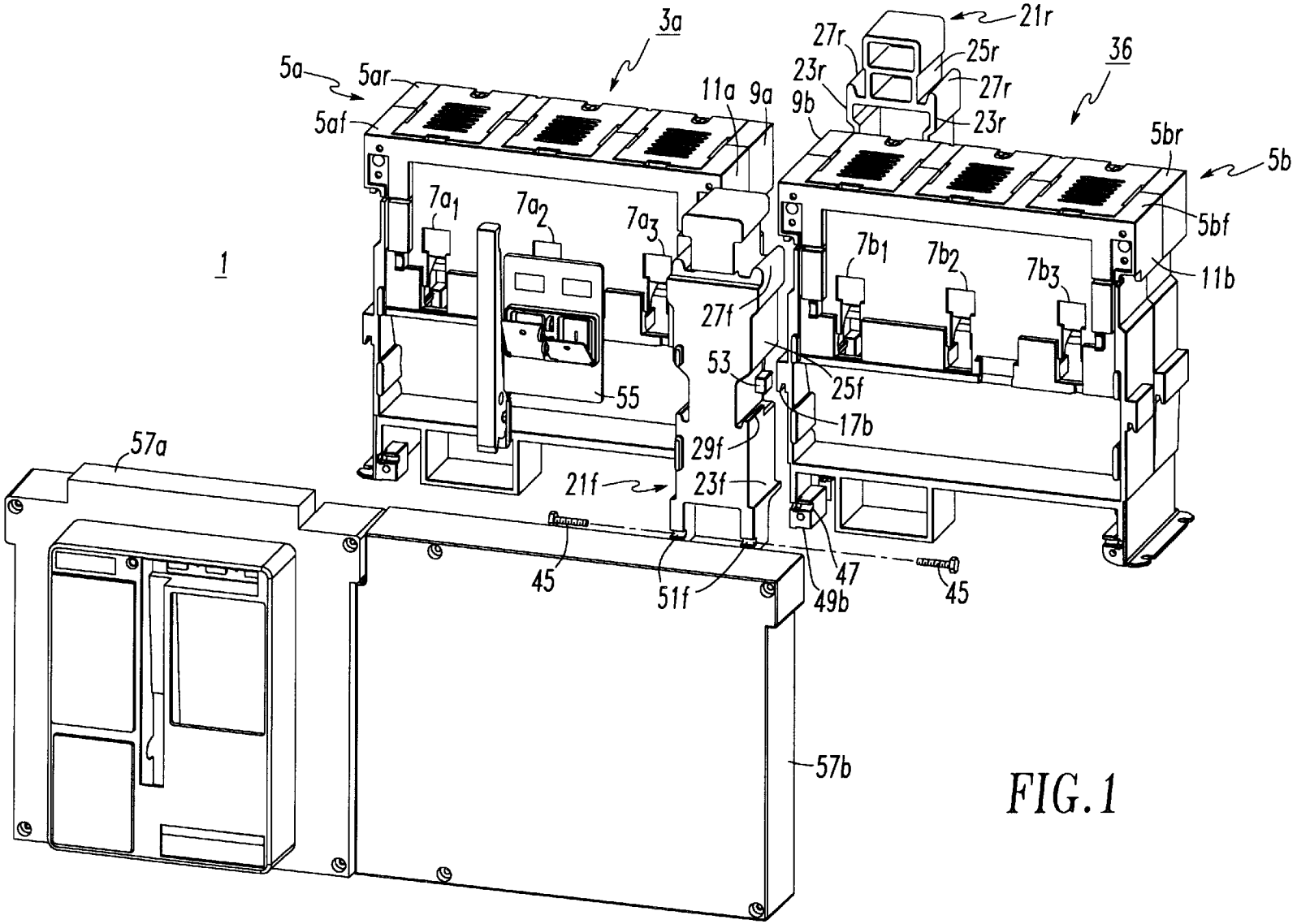
FIG. 1 is a front, exploded isometric view of electrical switching apparatus in accordance with the invention.
Figure 2:
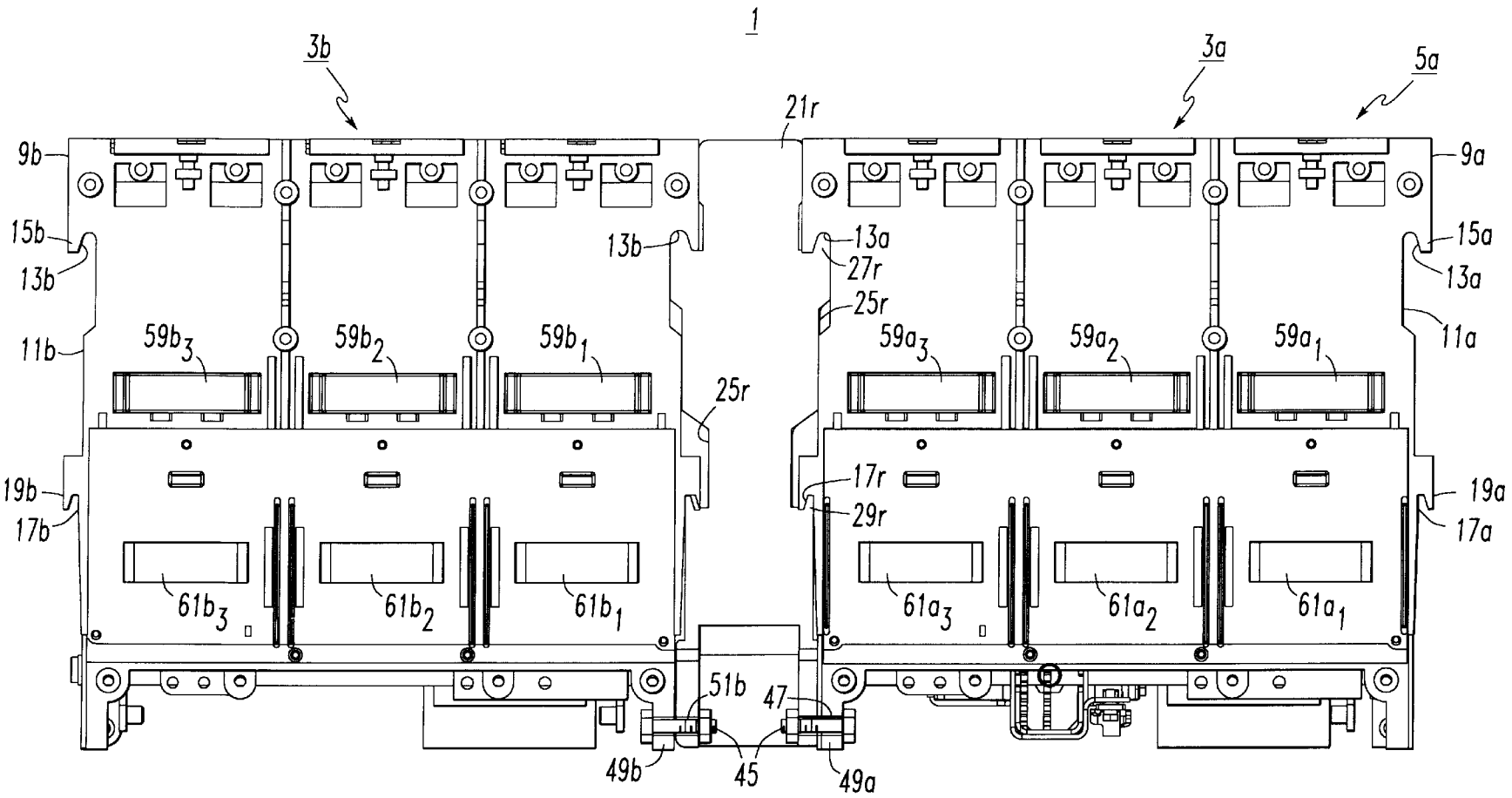
FIG. 2 is a rear elevation view of the apparatus of FIG. 1 assembled.

The invention is directed to electrical switching apparatus in which two switching units are joined together side-by-side to form a switching unit with a higher current capacity. It is applicable to electrical switching apparatus such as, for example, circuit breakers, network protectors, disconnect switches and transfer switches, and will be illustrated as applied to power circuit breakers. Thus, as shown in FIGS. 1 and 2, the electrical switching apparatus 1 includes a pair of molded case circuit breakers 3*a* and 3*b*. For convenience, the description is directed to the joining of a pair of circuit breakers; however, it will be apparent that the principles apply to joining any number of such units together side-by-side. Also, the circuit breakers 3*a* and 3*b* are shown as three-pole circuit breakers. It will also be apparent that the invention is applicable to units with other numbers of poles such as, for instance, four poles.

Each of the circuit breakers 3*a* and 3*b* includes a molded casing 5*a* and 5*b*. As is well known, such casings can be molded from an insulative resin such as a glass filled polyester. In the circuit breakers shown, each of the molded casings 5*a* and 5*b* includes a front casing 5*af* and 5*bf* and a rear casing 5*ar* and 5*br* which are joined together by bolts (not shown). The molded casings 5*a* and 5*b* house the circuit breaker poles $7a_1$–$7a_3$ and $7b_1$–$7b_3$, respectively. The molded casings 5*a* and 5*b* have sidewalls 9*a* and 9*b* with irregular surfaces 11*a* and 11*b*. The irregularities in the surfaces 9*a* and 9*b* include undercutting grooves 13*a* and 13*b* which undercut the surfaces 11*a* and *b*. These upper undercutting grooves 13*a* and *b* form downwardly projecting fingers 15*a* and *b* which serve as handles for lifting the circuit breakers. Lower down on the sidewalls 9*a* and *b* are additional upwardly directed undercutting grooves 17*a* and 17*b* which form downwardly projecting fingers 19*a* and 19*b*. These lower fingers or ledges 19*a* and 19*b* engage a cassette (not shown) for mounting the circuit breakers in a switchgear cabinet (also not shown).

Figure 3:
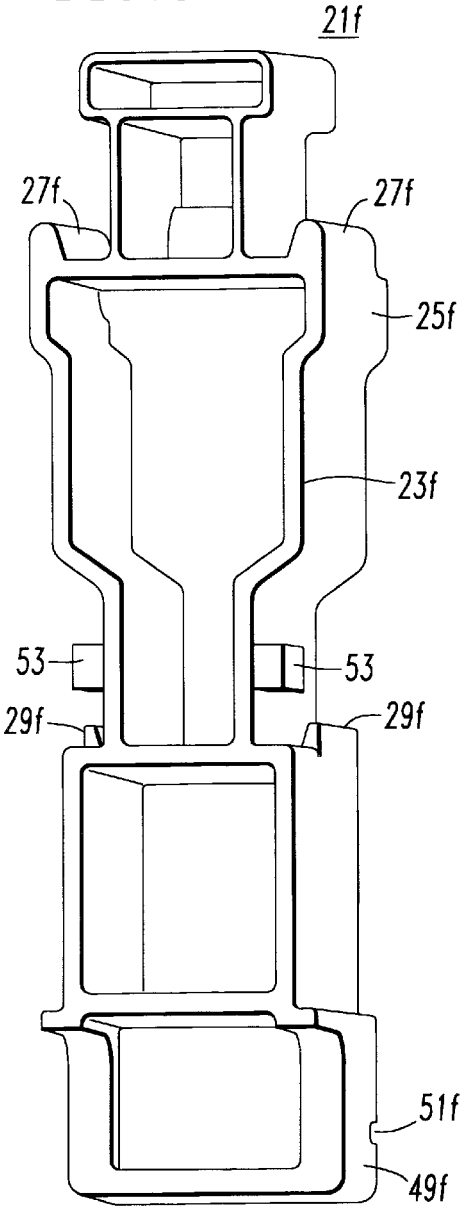
FIG. 3 is an isometric rear view of a front joining block in accordance with the invention.
Figure 4:
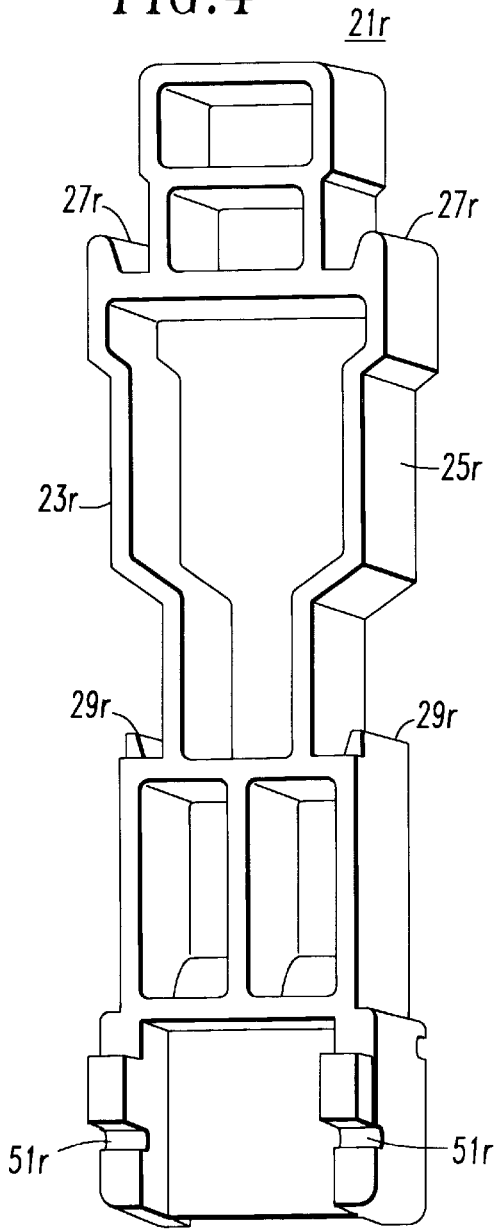
FIG. 4 is an isometric view similar to FIG. 3 of a rear joining block.

These undercutting grooves 13*a* and *b* and 17*a* and *b* in the sidewalls of the molded casings 5*a* and 5*b* are used in accordance with the invention for clamping the two circuit breakers 3*a* and 3*b* together. To this end, front and rear joining blocks 21*f* and 21*r* are provided (see FIGS. 3 and 4). As can be appreciated from FIGS. 1 and 2, the joining blocks 21*f* and 21*r* have sidewalls 23*f* and 23*r* with irregular surfaces 25*f* and 25*r* which are in general complementary to the confronting irregular surfaces 9*a* and 9*b* on the side-by-side circuit breakers 3*a* and 3*b*. Returning to FIGS. 3 and 4, the joining blocks 21*f* and 21*r* have first upwardly extending tongues 27*f* and 27*r* which extend generally along the sidewalls 23*f* and 23*r*. They also have lower upwardly extending tongues 29*f* and 29*r* which also extend along the sidewalls 23*f* and 23*r* below the tongues 27*f* and 27*r*. As can be seen from FIG. 2, the tongues 27*f* and 27*r* engage the undercutting grooves 13*a* and 13*b* while the tongues 29*f* and 29*r* engage the lower undercutting grooves 17*a* and 17*b*.

Figure 5:
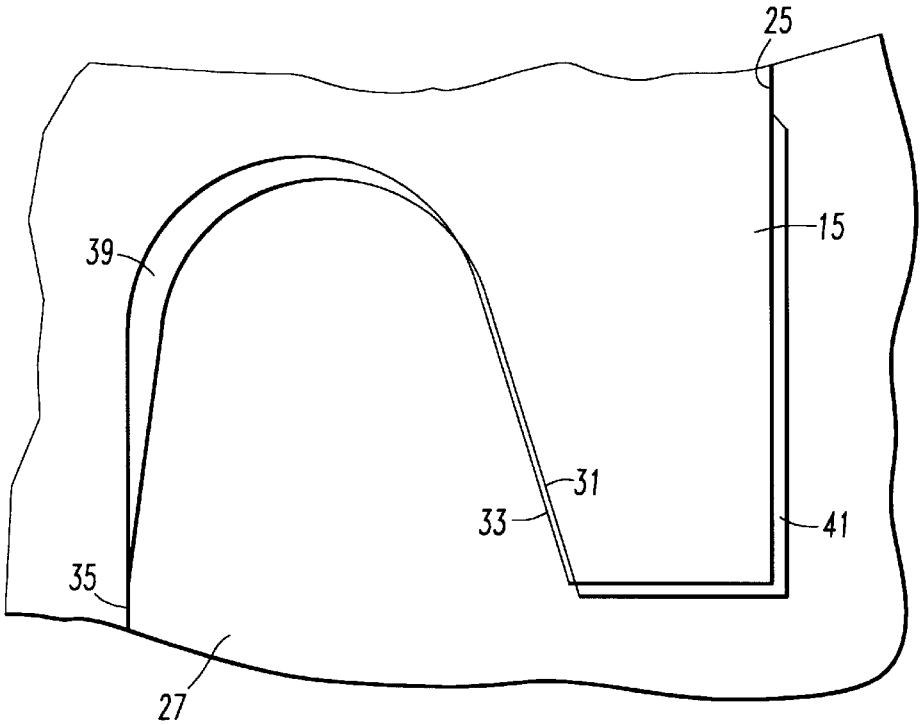
FIG. 5 is a diagram in enlarged scale illustrating an interference fit produced by the joining blocks of FIGS. 3 and 4.

The tongues 27 and 29 engage the grooves 13 and 17 with an interference fit which is best explained by reference to FIG. 5. As shown there, the tongue 27 has an inwardly directed inner surface 31 which engages an inwardly inclined inner surface 33 on the finger 15. The spacing of the tongue 27 from the surface 25 is such that an interference represented by the overlapping area 35 in FIG. 5 is created between the inclined surfaces 31 and 33. In the exemplary apparatus 1 this interference is about 0.005".

The joining block 21 has an outer engagement surface 35 which projects toward and engages the casing sidewall at 37 to provide a clearance 39 for the tongue 27. In addition, a small recess 41 is provided in a joining block 21 facing the inclined surface 31 on the tongue 27 to provide a clearance for the finger 15. The joining blocks 21 are also made of insulating material such as the glass filled polyester resin used for the molded casings. Thus, the tongues 27 and fingers 15 are compliant and bend outward, respectively, in response to the interference 35. The clearance 39 and the recess 43 provide room for this deflection of the tongue 27 and finger 15. Although not shown in detail, the lower tongues 29 and lower undercutting grooves 17 have similar interference and clearance which allows them to deflect. The fingers and tongues are formed with a small draft along the front/rear axis for removal from the respective molds. The interference fit extends along the drafted surfaces.

In joining the two circuit breakers 3*a* and 3*b*, the molded casings are inverted and the joining blocks 21*f* and 21*r* inserted with the tongues 27*f* and 27*r* engaging the undercutting grooves 13*a* and 13*b* and with the tongues 29*f* and 29*r* engaging the undercutting grooves 17*a* and 17*b*. The joining blocks are then driven parallel to the sidewalls 9*a* and 9*b* of the molded casings such as by a mallet to effect the interference fits described above. This draws the molded casings 5*a* and 5*b* together and firmly grips them. The joining blocks 21*f* and 21*r* are prevented from backing out by stop members in the form of bolts 45 which extend laterally through openings 47 in flanges 49*a* and 49*b* of the molded housings. These bolts 45 also engage openings formed by slots 51*f* and 51*r* in the joining blocks 21*f* and 21*r* to prevent them from backing out. A single long bolt (not shown) extending between the flanges 49*a* and 49*b* could be used in place of the two shorter bolts.

It has been noted that the forces generated in opening and closing the circuit breaker have a tendency to cause the joining blocks 21*f* and 21*r* to rotate about the bolts 45. In order to prevent this lateral disengagement of the tongues on the undercutting grooves, projections 53 are provided on the front joining block 21*f* to laterally engage the lower fingers 19*a* and 19*b* which only extend laterally over a portion of the sidewalls 9*a* and 9*b*.

Returning to FIG. 1, a single operating mechanism 55 is provided in only one of the side-by-side circuit breakers, which in the exemplary apparatus is the circuit breaker 3*a*. A common pole shaft (not shown) is coupled to the poles of each of the circuit breakers and rotated by the operating mechanism 55 for synchronized opening and closing of all of the poles simultaneously. The electrical switching apparatus 1 further includes a standard front cover 57*a* for the circuit breaker 3*a* with the operating mechanism and a modified cover 57*b* which encloses the front of the circuit breaker 3*b* and extends over the joining block 21*f*. As can be seen from FIG. 2, line side terminal conductors $\mathbf{59}a_1$–$\mathbf{59}b_3$ and load side terminal conductor $\mathbf{61}a_1$–$\mathbf{61}b_3$ project rearward from the casings 5*a* and 5*b*.

Figure 6:
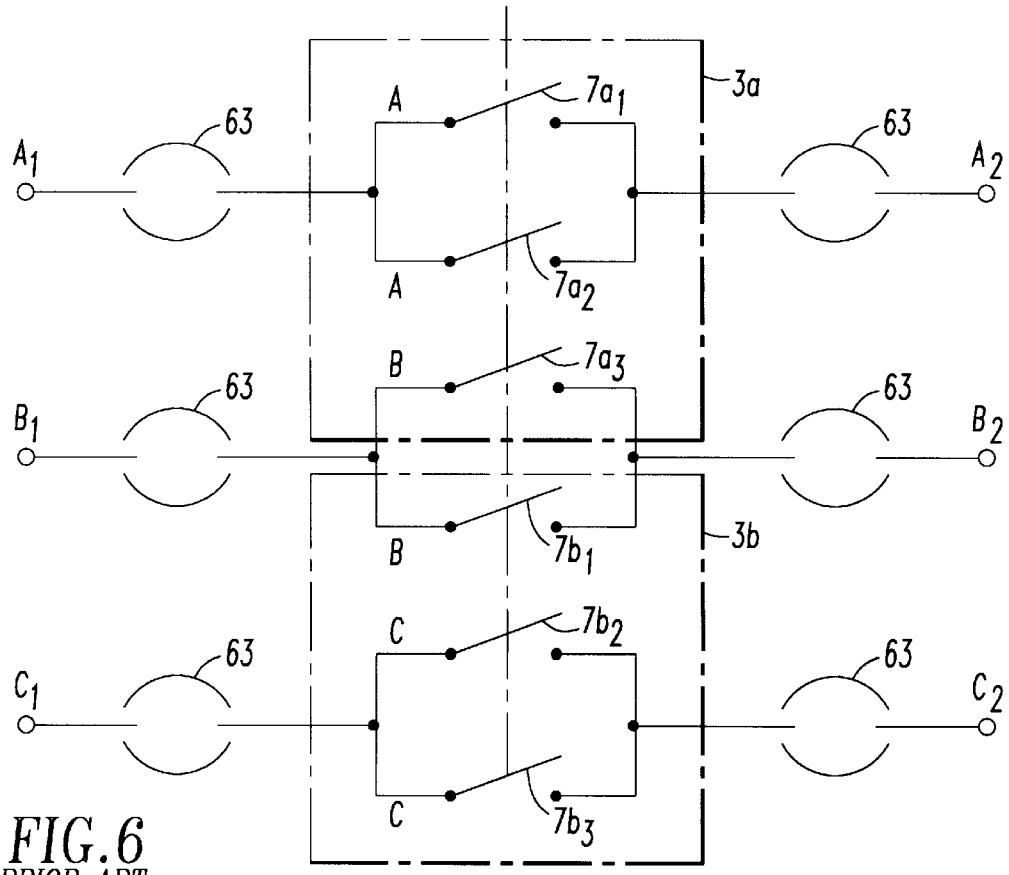
FIG.6 PRIOR ART
FIG. 6 is a schematic view illustrating the prior art connection of the poles of side-by-side switching units.

In accordance with the invention, the paralleling of the poles of the side-by-side circuit breakers 3*a* and 3*b* is effected outside of the circuit breakers by separate conductors so that the circuit breakers themselves are standardized and require no specialization for a particular paralleling arrangement. This is contrary to the standard practice which is illustrated in FIG. 6. In this conventional arrangement, adjacent poles (e.g., $\mathbf{7}a_1$ and $\mathbf{7}a_2$) are paralleled including the adjacent poles ($\mathbf{7}a_3$ and $\mathbf{7}b_1$) in the two circuit breakers which form the B phase. As mentioned, such an arrangement requires derating of the resulting circuit breaker by as much as twenty percent over the ratings of the individual circuit breakers. The connections between the adjacent phases are made internally of the circuit breaker before the disconnects 63. This requires modification to the units used in the side-by-side combination over the standard three pole circuit breaker.

Figure 7:
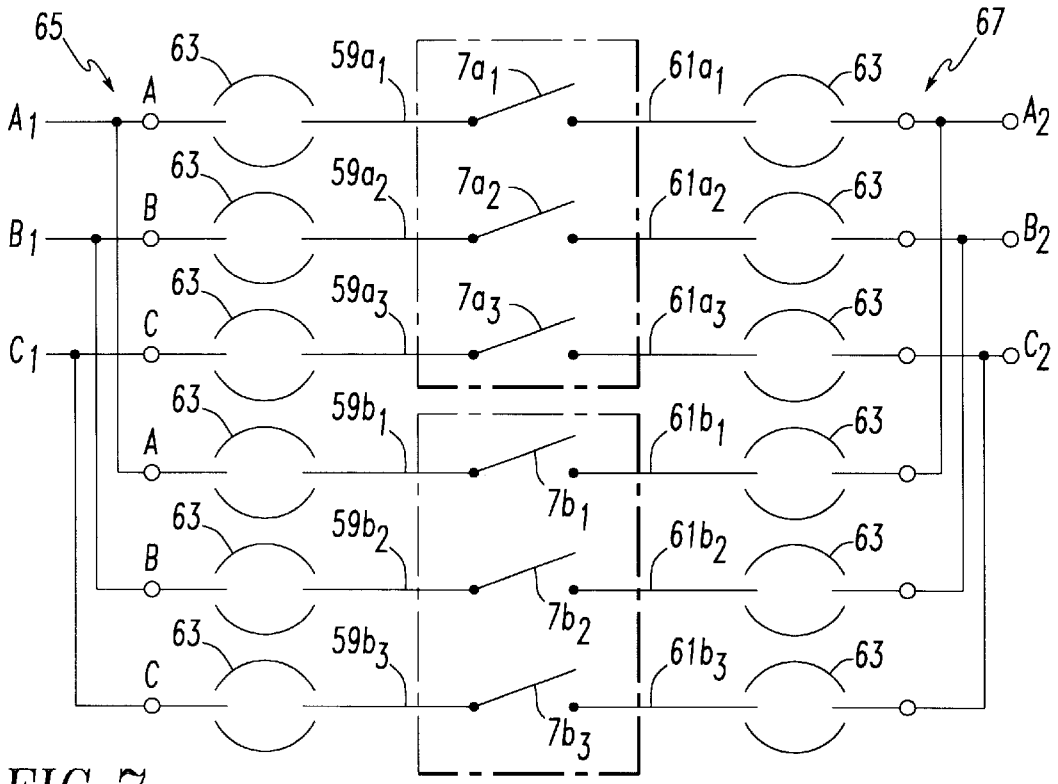
FIG. 7 is a schematic circuit diagram illustrating connection of the side-by-side switching units in accordance with one embodiment of the invention.

FIG. 7 illustrates that in accordance with the invention, the circuit breakers remain standard including their disconnects 63. Paralleling of the poles is accomplished by separate conductors, such as the conductors 65 on the line side and 67 on the load side. In the particular arrangement of FIG. 7, the poles are interleaved in an ABCABC sequence.

Figure 8:
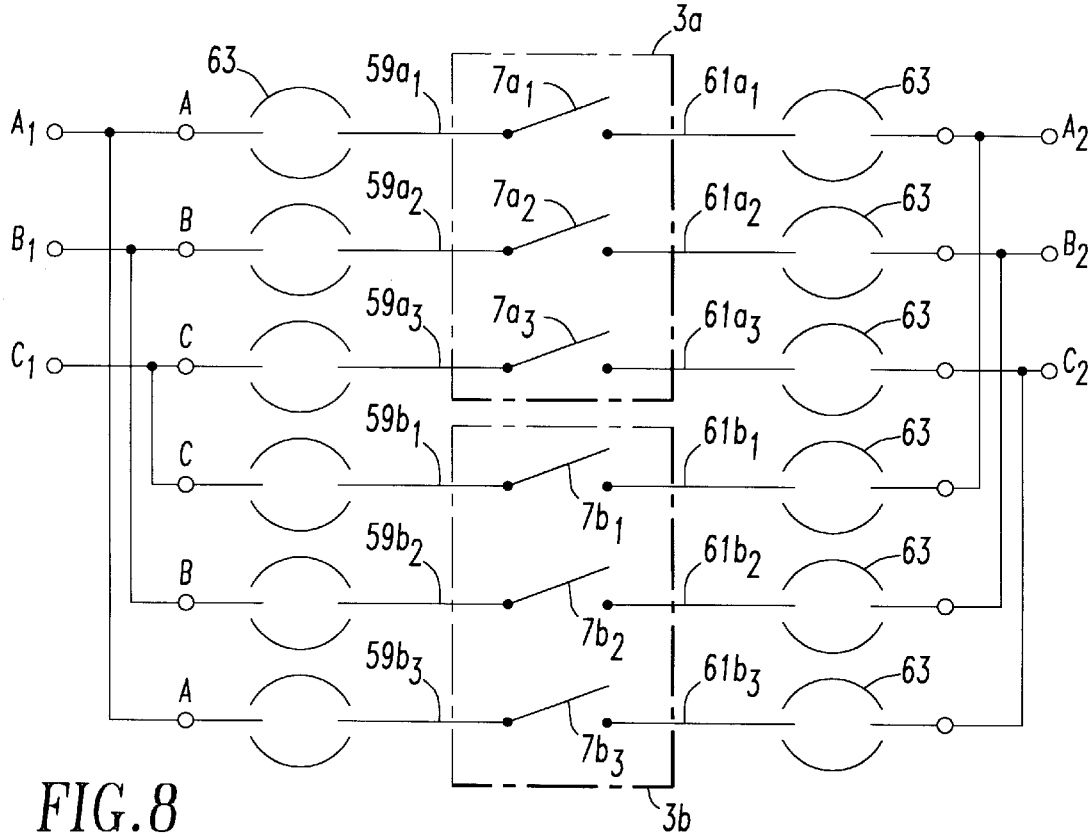
FIG. 8 is a schematic circuit diagram illustrating connection of the side-by-side switching units in accordance with another embodiment of the invention.

FIG. 8 illustrates another arrangement in accordance with the invention in which the poles of the side-by-side circuit breakers 3*a* and 3*b* are paralleled by separate conductors 65' on the line side and 67' on the load side. In this configuration the poles are paralleled in an ABCCBA sequence. It will be apparent that in accordance with the invention the poles can be paralleled in any configuration desired using the external conductors including AABBCC. With this approach, the circuit breakers 3*a* and 3*b* remain standard. No specialization of the circuit breakers for a particular paralleling arrangement is required.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. Electrical switching apparatus comprising:

a pair of side-by-side multipole switching units each including a molded casing with a confronting casing sidewall having an irregular surface including at least one undercutting groove undercutting said irregular surface;

a joining block having block sidewalls with irregular surfaces generally complementary to said irregular surfaces on said confronting casing sidewalls and each of said block sidewalls including at least one tongue spaced from and extending generally along said each block sidewall and sized to form an interference fit with said at least one undercutting groove in a facing confronting casing sidewall of said side-by-side multipole switching units as said joining block is driven between and along said confronting casing sidewalls to clamp said molded casings together; and a stop member secured to said molded casings of said pair of multipole switching units preventing said joining block from disengaging from said molded casings.

2. The electrical switching apparatus of claim 1 wherein said at least one undercutting groove in each of said casing sidewalls forms a finger extending generally along said casing sidewall and having an inwardly inclined inner surface, said at least one tongue having an inwardly inclined inner surface engaging said inclined inner surface on said finger to effect said interference fit.

3. The electrical switching apparatus of claim 2 wherein said joining block has an outer engagement surface adjacent said at least one tongue which projects toward and engages said facing confronting casing sidewall to provide clearance for said at least one tongue to bend outward from said joining block upon engagement with said finger.

4. The electrical switching apparatus of claim 3 wherein said joining block has a recess facing said inwardly inclined inner surface on said at least one tongue to provide clearance for said finger to bend outward from said facing confronting casing sidewall upon engagement with said at least one tongue.

5. The electrical switching apparatus of claim 4 wherein said molded casings of said switching units include a front casing with said confronting sidewall with said at least one undercutting groove forming said finger and a rear casing removable from said front casing and having said confronting sidewall with said at least one undercutting groove forming said finger, and said joining block comprises a front joining block having sidewalls each with said at least one tongue for engaging said fingers on said front casings, and a rear joining block having sidewalls with said at least one tongue for engaging said fingers on said rear casings, and said stop member comprises a front stop member secured to said front casing preventing said front joining member from disengaging from said front casings and a rear stop member secured to said rear casings preventing said rear joining block from disengaging from said rear casings.

6. The electrical switching apparatus of claim 5 wherein said sidewalls of said molded casings have two undercutting grooves forming two fingers, and wherein said joining block has on each sidewall two tongues engaging said two undercutting grooves in facing casing sidewalls.

7. The electrical switching apparatus of claim 2 wherein said joining block has a recess facing said inwardly inclined inner surface on said at least one tongue to provide clearance for said finger to bend outward from said casing sidewall upon engagement with said at least one tongue.

8. The electrical switching apparatus of claim 2 wherein said joining block includes means preventing lateral disengagement of said at least one tongue on each said block side wall from said at least one undercutting groove.

9. The electrical switching apparatus of claim 8 wherein each said finger only extends laterally across a portion of said casing sidewall and said joining block has a projection on each said block side wall laterally engaging said at least one finger with said at least one tongue engaging said at least one undercutting groove.

10. The electrical switching apparatus of claim 9 wherein each said undercutting groove is adjacent one end of said casing sidewall, each said at least one tongue is adjacent a corresponding end of said block sidewall of said joining block, and said stop member engages said joining block and said molded casings adjacent other ends of said molded casings and said joining block.

11. The electrical switching apparatus of claim 1 wherein each said at least one undercutting groove is adjacent one end of said molded casing sidewall, each said at least one tongue is adjacent a corresponding end of said joining block and said stop member engages said joining block and said molded casings adjacent other ends of said molded casing and said joining block.

12. The electrical switching apparatus of claim 11 wherein said joining block includes means preventing lateral disengagement of one each said at one tongue from said at least one undercutting groove.

13. The electrical switching apparatus of claim 1 wherein said molded casings include upper and lower undercutting grooves in said sidewalls and said joining block has upper and lower tongues on said block sidewalls aligned for engaging said upper and lower undercutting grooves.

14. The electrical switching apparatus of claim 13 wherein said molded casings of said switching units include a front casing with a part of said confronting sidewall with said at least one undercutting groove forming a finger and a rear casing removable from said front casing and having a part of said confronting sidewall with said at least one undercutting groove forming a finger, and said joining block comprises a front joining block having sidewalls each with said at least one tongue for engaging a said finger on said front casings, and a rear joining block having sidewalls with said at least one tongue for engaging a said finer on said sidewalls of said rear casings, and said stop member comprises a front stop member secured to said front casing preventing said front joining member from disengaging from said front casings and a rear stop member secured to said rear casings preventing said rear joining block from disengaging from said rear casings.

15. The electrical switching apparatus of claim 14 wherein said molded casings include upper and lower undercutting grooves in said sidewalls and said joining blocks have upper and lower tongues on said block sidewalls aligned for engaging said upper and lower undercutting grooves.

16. The electrical switching apparatus of claim 1 wherein said molded casings have flanges with openings adjacent a driven end of said joining block, and said stop member comprises an elongated member extending through said openings and engaging said joining block adjacent said driven end between said flanges.

17. The electrical switching apparatus of claim 1 wherein poles of each multipole switching unit of said pair of side-by-side multipole switching units have a predetermined spacing and said joining block is sized to establish said predetermined spacing between adjacent poles of said pair of side-by-side multipole switching units.

18. The electrical switching apparatus of claim 1 including conductors external to said multipole switching units connecting corresponding poles of said switching units in parallel.

19. High current rating electrical switching apparatus comprising:

at least two multipole switching units mounted side-by-side; and conductor members electrically connecting corresponding poles from each of said at least two multipole switching units together in parallel.

20. The high current rating electrical switching apparatus of claim 19 wherein each of said at least two multipole switching units has a phase A, B, and C pole side-by-side, and said conductor members connect said phase A poles together, said B poles together, and said C poles together.

21. The high current rating electrical switching apparatus of claim 19 including means rigidly connecting said at least two multipole switching units together side-by-side.

22. The high current rating electrical switching apparatus of claim 21 wherein said poles of each of said at least two multipole switching units have a predetermined spacing between them and said means rigidly connecting said at least two switching units together is sized to establish said predetermined spacing between adjacent poles of the at least two multipole switching units.

* * * * *